US005431099A

United States Patent [19]

Maass et al.

[11] Patent Number: 5,431,099

[45] Date of Patent: Jul. 11, 1995

[54] DEVICE FOR MEASURING CONTACT PRESSURE OF A GRIPPER DEVICE IN A SHEET-FED ROTARY PRINTING PRESS

[75] Inventors: Jürgen Maass, Wiesloch; Thomas Kurzer, Eppelheim, both of Germany

[73] Assignee: Heidelberger Druckmaschinen AG, Heidelberg, Germany

[21] Appl. No.: 133,460

[22] Filed: Oct. 8, 1993

[30] Foreign Application Priority Data

Oct. 8, 1992 [DE] Germany ..... 42 33 867.0

[51] Int. Cl.[6] ..... B41F 1/30

[52] U.S. Cl. ..... 101/408; 101/409

[58] Field of Search ..... 101/408, 409; 73/862.53, 862.628, 862.629, 862.044, 862.045, 862.046

[56] References Cited

U.S. PATENT DOCUMENTS

| | | | |
|---|---|---|---|
| 3,582,691 | 6/1971 | Sonderegger et al. | 310/8.4 |
| 4,491,760 | 1/1985 | Linvill | 73/862.046 |
| 4,780,015 | 10/1988 | Anderson et al. | 400/662 |
| 4,953,410 | 9/1990 | Tabota | 73/862.046 |
| 5,209,126 | 5/1993 | Grahn | 73/862.046 |

FOREIGN PATENT DOCUMENTS

| | | | |
|---|---|---|---|
| 0179437 | 4/1990 | European Pat. Off. . | |
| 0438861 | 7/1991 | European Pat. Off. . | |
| 0459948 | 12/1991 | European Pat. Off. . | |
| 0544111 | 6/1993 | European Pat. Off. . | |
| 2220428 | 9/1973 | Germany . | |
| 3438929 | 4/1986 | Germany | 101/409 |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Device for measuring contact pressure of a gripper device having a gripper member and a gripper pad in a sheet-fed rotary printing press includes a layer of piezoelectric material, one of the gripper member and the gripper pad being formed of two parts with the layer of piezoelectric material disposed between the two parts, and a device for picking-off a charge from the layer of piezoelectric material which is a measure of contact pressure between the gripper member and the gripper pad of the gripper device.

14 Claims, 4 Drawing Sheets

DEVICE FOR MEASURING CONTACT PRESSURE OF A GRIPPER DEVICE IN A SHEET-FED ROTARY PRINTING PRESS

The invention relates to a device for measuring contact pressure of a gripper device having a gripper and a gripper pad in a sheet-fed rotary printing press.

Sheets are transported through a rotary printing press by means of gripper devices, which are combined as gripper bars and associated with the impression and transfer cylinders of individual printing units. A precise adjustment or setting of the gripper devices is essential to a friction-free transport of sheets through the rotary printing press.

The gripper devices, prior to installation thereof in the rotary printing press, are assembled and adjusted so that, during gripper closing, an adequate holding moment is exerted upon a sheet gripped thereby. In order to continue to ensure an adequate holding moment even after a lengthy period of service, readjustment is necessary because, in the course of time, wear and material fatigue of the gripper devices become noticeable. In extreme cases, an inadequate holding moment results in the loss of a sheet in the printing press, causing damage to the press; normally, printed waste is produced, because the sheet slips in the gripper devices, which inevitably leads to the occurrence of register errors in the printed image.

In addition, care must be taken, when the gripper devices are being set, that the gripper clamping surface of the gripper member is aligned parallel to the sheet gripper pad. Only with such an adjustment will the sheet be gripped across the entire surface of the gripper pad, i.e., will the gripper exert a full holding force. If the gripper clamping surface is just slightly askew with respect to the gripper pad, the gripper becomes a so-called edge carrier. When the sheet is accepted by an edge carrier, the sheet is held on only one side thereof and possibly slips back on the other side thereof. As a consequence thereof, register errors likewise occur in the printed image., Furthermore, particularly at high press speeds, it has been impossible heretofore to provide information with regard to the uniformity of the instants of closing and opening of the grippers in the individual gripper bars.

Heretofore known from the published European Patent Document 01 79 437 B1 is a measuring device for measuring gripper contact pressure in sheet-fed rotary printing presses. The measuring device includes a sensor which is disposed between a gripper tip and a gripper pad of a gripper device. The sensor is formed of three layers: an elastic substrate layer having a varying electrical resistance, a conducting layer disposed thereon, and an insulating layer. The electrical resistance value of the sensor which is obtained depending upon the loading or gripping force of the gripper device is determined through the intermediary of a measuring-bridge circuit and serves as a measure of the gripper contact pressure.

The determination of the contact pressure based upon the variations in the resistance of a conductive, foam-like material is attended by several disadvantages. One cannot exclude the possibility, for example, of a change in the electrical and mechanical properties of the material in the course of time, thereby imposing limits on the reproducibility of the measured values. Furthermore, the measuring apparatus described in the aforementioned published European Patent Document 01 79 437 B1 is not capable of providing information on whether a gripper device is carrying the sheet only on one edge. Transverse forces, which occur as a result of setting the gripper tip down on one edge, may moreover displace the measuring device between the gripper pad and the gripper tip. In addition, the reaction or response time until a change in resistance can be indicated reliably is relatively long due to the high compressibility of the elastic, foam-like material. Particularly at high press speeds, therefore, it is not possible to provide reliable information with regard to the uniformity of the opening and closing motions of two gripper devices. One must also take into account that the measuring-bridge circuit requires continuous adjustment, which results in increased effort or expense and in a time delay with respect to the evaluation of the measurement results.

It is accordingly an object of the invention to provide a device for measuring contact pressure of a gripper device having a gripper and a gripper pad in a sheet-fed rotary printing press which always delivers reliable measurement results for a holding moment of the gripper device.

With the foregoing and other objects in view, there is provided, in accordance with the invention, a device for measuring contact pressure of a gripper device having a gripper member and a gripper pad in a sheet-fed rotary printing press, comprising a layer of piezoelectric material, one of the gripper member and the gripper pad being formed of two parts with the layer of piezoelectric material disposed between the two parts, and means for picking-off a charge from the layer of piezoelectric material which is a measure of contact pressure between the gripper member and the gripper pad of the gripper device.

Two equivalent embodiments of the inventive device are provided: namely, the gripper pad is formed of a top and a bottom part, and a layer of piezoelectric material is disposed between the two parts, the charge which is picked off from the piezoelectric material serving as a measure of the contact pressure of the gripper device; and the gripper member has a gripper tip formed of a top and a bottom part in a region of a gripper clamping surface, and a layer of piezoelectric material is disposed between the two parts of the gripper tip, the charge which is picked off from the piezoelectric material serving as a measure of the contact pressure of the gripper device.

Thus, in accordance with a feature of the invention, the gripper member has a gripper tip formed of the two parts in a region of a gripper surface thereof movable into a position adjacent the gripper pad and, in accordance with an alternative feature of the invention, the gripper pad is formed of the two parts in vicinity of a pad surface thereof.

In accordance with a further feature of the invention, the layer of piezoelectric material is a piezoelectric foil.

In accordance with an added feature of the invention, the piezoelectric material is a piezoceramic.

In order to be able to provide information on whether the gripper device is gripping a sheet over the entire gripper clamping surface or whether it is carrying it on just one edge, there is proposed, in accordance with an additional feature of the invention, that the layer of piezoelectric material be divided into longitudinal strips electrically insulated from one another.

In accordance with yet another feature of the invention, the layer of piezoelectric material is divided into transverse strips electrically insulated from one another. By so dividing the piezoelectric material into transverse strips which are electrically insulated from one another, it is possible to obtain information as to whether the gripper clamping surface is being set down in parallel or at a given angle with respect to the gripper pad.

In accordance with yet a further feature of the invention, connecting elements are provided for connecting the two parts so as to exert a defined pressure on the layer of piezoelectric material. The pressure exertion is exerted from the outset. The piezoelectric material is thus "prestressed" as it were, by this measure This excludes the possibility of the piezoelectric material being displaced between the two parts of the gripper pad or of the gripper tip or member, so that the charge measured at the piezoelectric material can be used exclusively, and consequently reliably, as a measure of the contact pressure.

In accordance with yet an added feature of the invention, the connecting elements are angle elements fastened to respective sides of the gripper pad or the gripper member, whichever is formed of the two parts.

In accordance with yet an additional feature of the invention, the connecting elements are disposed in side regions of the respective one of the gripper pad and the gripper member, and means are included for exerting a spring force, the two parts being connected to one another by the connecting elements through the intermediary of the means for exerting a spring force.

In accordance with an alternative feature of the invention, the connecting elements are disposed in side regions of the respective one of the gripper pad and the gripper member, and means are included for exerting tensile stress, the two parts being connected to one another by the connecting elements through the intermediary of the means for exerting tensile stress.

In accordance with another feature of the invention, a charge amplifier is connected to the means for picking off the charge from the piezoelectric material for amplifying the charge.

In accordance with a concomitant feature of the invention, the contact-pressure measuring device includes a microprocessor connected to the charge amplifier for computing from a voltage value formed from the amplified charge at least one of a respective contact pressure and a respective distribution of contact pressure of the gripper device. The amplified charge is conducted via a voltage transformer and an A/D converter to the microprocessor.

Other features which are considered as characteristic for the invention are set forth in the appended claims.

Although the invention is illustrated and described herein as embodied in a device for measuring contact pressure of a gripper device in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
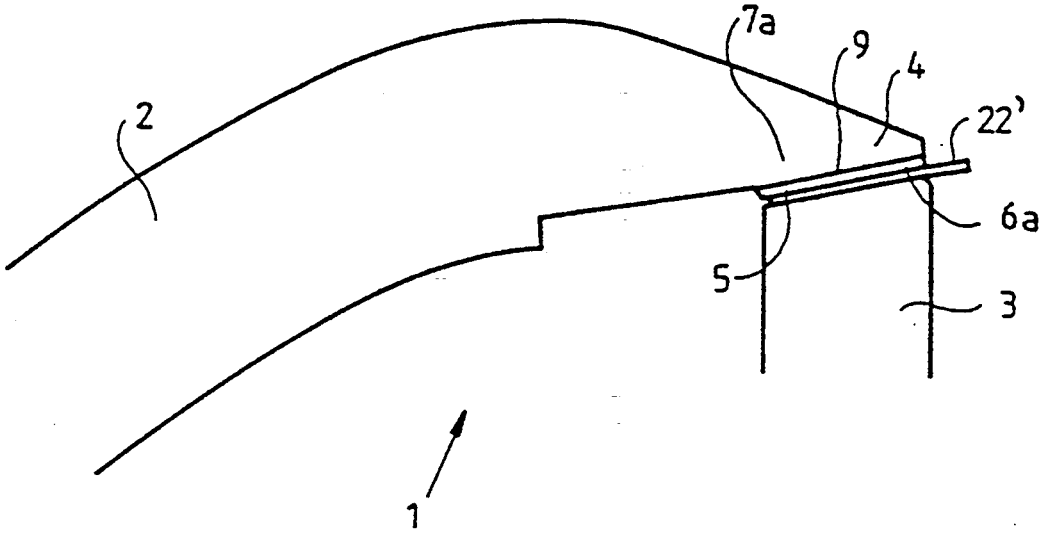
FIG. 1 is a fragmentary diagrammatic side elevational view of a gripper device provided with a device for measuring contact pressure thereof in accordance with the invention.

Referring now to the drawings and, first, particularly to FIG. 1 thereof, there is shown therein a diagrammatic side elevational view of a gripper device 1 formed of conventional parts, namely a gripper member 2 and a gripper pad 3. A sheet 22' is gripped between a gripper clamping surface 5 of the gripper member 2 and the gripper pad 3.

In accordance with the invention, the gripper member 2 of the embodiment shown in FIG. 1 is divided into two parts *6a* and *7a* in a gripper tip region 4 of the gripper member 2. Piezoelectric material 9, especially in the form of a piezoelectric foil of the type marketed, for example, by the firm Solvey, is disposed between the two parts *6a* and *7a*. The piezoelectric material is preferably a piezoceramic.

Figure 2:
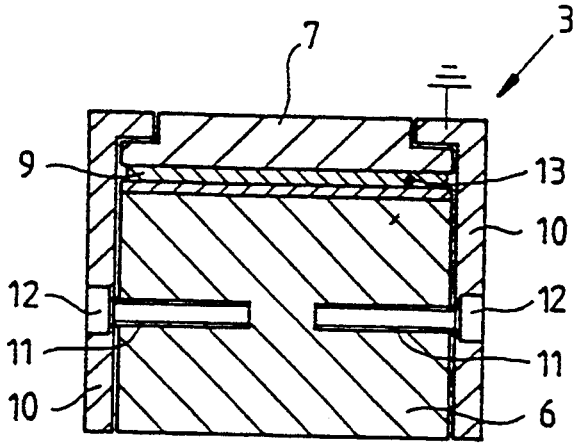
FIG. 2 is an enlarged cross-sectional view, partly schematic, of another embodiment of the gripper device provided with the contact-pressure measuring device according to the invention.

FIG. 2 is a cross-sectional view of the gripper pad 3 of another embodiment of the gripper device 1 constructed in accordance with the invention. In this embodiment, the gripper pad 3 is divided into a lower part 6 and an upper part 7. The piezoelectric material 9, particularly in the form of the piezoelectric foil, is disposed between the two parts 6 and 7. As viewed in FIG. 2, the lower part 6 conducts only on a side thereof facing the piezoelectric material 9. The other surfaces of the lower part 6, just like corresponding surfaces of the upper part 7, are electrically insulated. The gripper pad 3 is thereby at ground potential, as indicated symbolically at the top of FIG. 2. A charge which builds up at the piezoelectric material 9 under a pressure load is discharged via a pin 13.

A connection between the lower part 6 and the upper part 7 of the gripper pad 3 of FIG. 2 is effected by connecting elements 10, which are fastened to the side surfaces of the gripper pad 3. The connecting elements 10 are angle elements, which are fastened to the gripper pad 3 by screws 12, which extend into threaded transverse holes 11 formed in the lower part 6 of the gripper pad 3. The connecting elements 10 are of such dimensions that, when installed, a defined pressure is exerted on the piezoelectric material 9. This so-called "prestressing" prevents displacement of the piezoelectric material 9 during the printing process.

Figure 3:
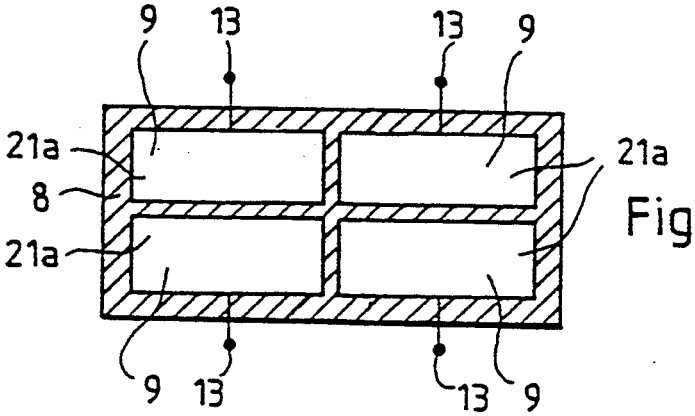
FIG. 3 is a top plan view of a particular embodiment of an element with piezoelectric material forming part of the device according to the invention.

FIG. 3 is a top plan view of a special embodiment of the piezoelectric material 9. The piezoelectric material 9 is divided into four regions (of longitudinal or transverse strips) which are electrically insulated from one another. By such a division, assurance can be provided that not only is the holding moment of the gripper device 1 determinable, but also, specific or targeted information regarding the pressure distribution at gripper closing may be obtained.

Figure 4:
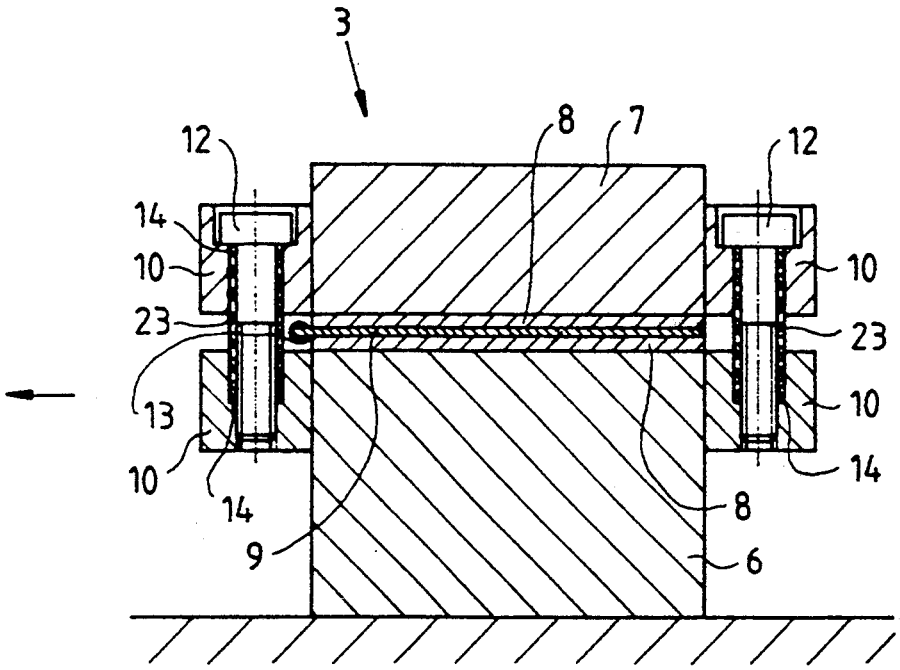
FIG. 4 is a view like that of FIG. 2 of a further embodiment of the gripper device provided with the contact-measuring device according to the invention.

FIG. 4 shows a further embodiment of the device according to the invention. Just as in the aforedescribed embodiment of the invention shown in FIG. 2, the gripper pad 3 is once again divided into a lower part 6 and an upper part 7. The piezoelectric material 9 is disposed between the two parts 6 and 7. In order to insulate the piezoelectric material 9 electrically from the gripper pad 3, an insulating layer 8, like that of FIG. 3, is provided on both sides of the piezoelectric layer 9 in FIG. 4. The instant that pressure is exerted upon the piezoelectric material 9, an electric charge builds up and is discharged via the pin or pins 13 (note also FIG. 3).

A connection between the lower part 6 and the upper part 7 of the gripper pad 3, as viewed in FIG. 4, is provided by connecting elements 10, which are affixed in the side regions of the upper and lower parts 6 and 7. Each of the connecting parts 10 is formed with a threaded bore 14, in which a screw 12 is threadedly secured. The piezoelectric material 9 is "prestressed" by tensioning of a spring 23, which causes a defined pressure to be exerted upon the piezoelectric material 9.

Figure 5:
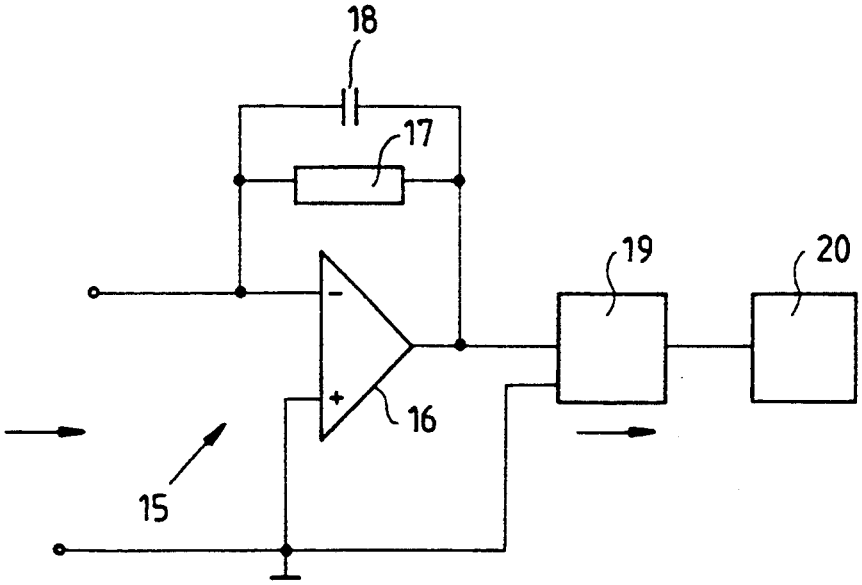
FIG. 5 is a circuit diagram of an arrangement for evaluating measured values registered by the contact-pressure measuring device in the gripper device in accordance with the invention.
Figure 6:
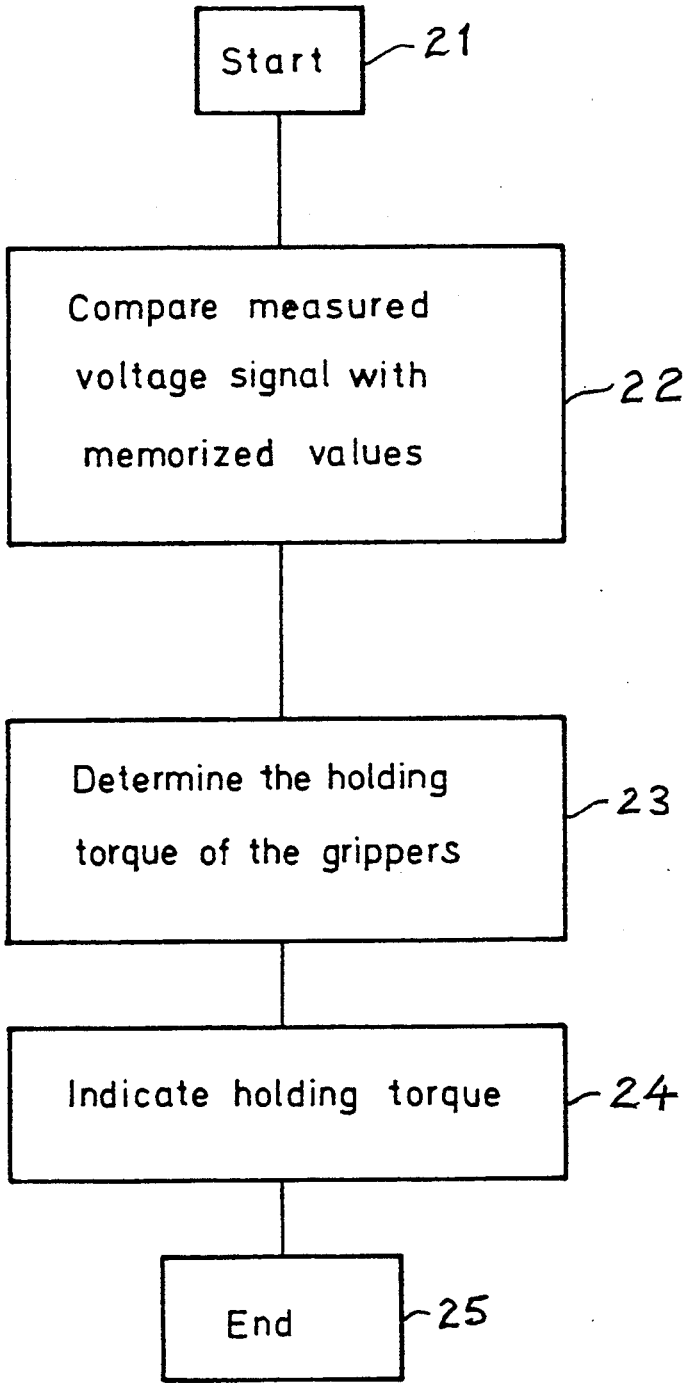
FIG. 6 is a flow chart depicting how holding torque of the gripper device is determined from the measured values.

FIG. 5 shows a circuit arrangement of the type employed for processing and evaluating the charge which is picked off the piezoelectric material 9. Provided therein is an amplifier circuit which is a conventional charge amplifier 15. The charge is transmitted from the piezoelectric material 9, as indicated by the arrow at the left-hand side of FIG. 5, to a negative input of an operational amplifier 16. What is amplified is the difference in the charge which is picked off from the piezoelectric material 9 and referenced to ground potential. The charge present at the output of the operational amplifier 16 is returned via a resistor 17 and a capacitor 18 to the negative input of the operational amplifier 16. The amplification factor is determined through the intermediary of the capacitor 18 so that a reliable signal is present at the output of the charge amplifier 15. The amplified charge is then converted into a voltage signal. The analog voltage values are digitized through the intermediary of an analog-to-digital or A/D converter 19 and are fed to a microprocessor 20. By comparing the calculated voltage signals with stored setpoint values, the microprocessor 20 determines the respective instantaneous holding moment or torque of the gripper device 1. Thus, as shown in the flow chart of FIG. 6, a program is started at 21 in the computer 20 wherein the measured voltage signal is compared with previously inputted or memorized values at 22 and, in accordance with the difference therebetween, the holding torque or moment of the grippers or gripper device 1 is determined at 23 and indicated at 24 before the program is ended at 25.

If the piezoelectric material 9 is divided in the manner shown in FIG. 3, it is additionally possible, based upon a setpoint/actual-value comparison, to determine the pressure distribution in the gripper device 1.

We claim:

1. Device for measuring contact pressure of a gripper device having a gripper member and a gripper pad in a sheet-fed rotary printing press, comprising a layer of piezoelectric material, one of the gripper member and the gripper pad being formed of first and second parts with said layer of piezoelectric material disposed between said first and second parts, said first part having a surface facing the other of the gripper member and gripper pad and forming a gap therewith in which a sheet is gripped with a contact pressure, and means for picking-off a charge from said layer of piezoelectric material which is a measure of the contact pressure between the gripper member and the gripper pad of the gripper device.

2. Device according to claim 1, wherein the gripper member has a gripper tip formed of said two parts in a region of a gripper surface thereof movable into a position adjacent the gripper pad.

3. Device according to claim 1, wherein the gripper pad is formed of said two parts in vicinity of a pad surface thereof.

4. Device according to claim 1, wherein said layer of piezoelectric material is a piezoelectric foil.

5. Device according to claim 1, wherein the piezoelectric material is a piezoceramic.

6. Device according to claim 1, wherein said layer of piezoelectric material is divided into longitudinal strips electrically insulated from one another.

7. Device according to claim 1, wherein said layer of piezoelectric material is divided into transverse strips electrically insulated from one another.

8. Device according to claim 1, including connecting elements connecting said two parts so as to exert a defined pressure on said layer of piezoelectric material.

9. Device according to claim 8, wherein said connecting elements are angle elements fastened to respective sides of said one of the gripper pad and the gripper member.

10. Device according to claim 8, wherein said connecting elements are disposed in side regions of said one of the gripper pad and the gripper member, and including means for exerting a spring forced said two parts being connected to one another by said connecting elements through the intermediary of said means for exerting a spring force.

11. Device according to claim 8, wherein said connecting elements are disposed in side regions of said one of the gripper pad and the gripper member, and including means for exerting tensile stress, said two parts being connected to one another by said connecting elements through the intermediary of said means for exerting tensile stress.

12. Device according to claim 1, including a charge amplifier connected to said means for picking off the charge from the piezoelectric material for amplifying the charge.

13. Device according to claim 12, including a microprocessor connected to said charge amplifier for computing from a voltage value formed from the amplified charge at least one of a respective contact pressure and a respective distribution of contact pressure of the gripper device.

14. Device for measuring contact pressure of a gripper device having a gripper member and a gripper pad in a sheet-fed rotary printing press, wherein the gripper member and the gripper pad each have respective gripper surfaces defining a gap therebetween for receiving and retaining a sheet therein, the device comprising a layer of piezoelectric material, the gripper pad being formed of first and second parts with said layer of piezoelectric material disposed between said first and second parts, said first part having first surface directly adjacent said layer of piezoelectric material and a second surface opposite said first surface facing the gripper member and forming a gap therewith in which a sheet is gripped with a contact pressure, and means for picking off a charge from said layer of piezoelectric material which is a measure of the contact pressure between the gripper member and the gripper pad of the gripper device.

* * * * *